US008462977B2

(12) United States Patent
Wang

(10) Patent No.: US 8,462,977 B2
(45) Date of Patent: Jun. 11, 2013

(54) LOUDSPEAKER WITH MAGNETIC ELEMENTS FIXEDLY PROVIDED ON DIAPHRAGM

(76) Inventor: Chao-Lang Wang, Xizhi (TW)

( * ) Notice: Subject to any disclaimer, the term of this patent is extended or adjusted under 35 U.S.C. 154(b) by 364 days.

(21) Appl. No.: 12/805,354

(22) Filed: Jul. 27, 2010

(65) Prior Publication Data

US 2011/0243370 A1 Oct. 6, 2011

(30) Foreign Application Priority Data

Apr. 6, 2010 (TW) ..... 99110530 A

(51) Int. Cl.

| | |
|---|---|
| ***H04R 1/22*** | (2006.01) |
| *H04R 1/00* | (2006.01) |
| *H04R 1/20* | (2006.01) |
| *H04R 9/06* | (2006.01) |
| *H04R 11/02* | (2006.01) |

(52) U.S. Cl.
USPC ..... 381/413; 381/421

(58) Field of Classification Search
USPC ..... 381/413, 412, 418, 420, 421, 403, 381/404, 416, 417; 335/222, 229
See application file for complete search history.

(56) References Cited

U.S. PATENT DOCUMENTS

| | | | | |
|---|---|---|---|---|
| 2,951,190 | A * | 8/1960 | Baermann | 335/231 |
| 3,937,904 | A * | 2/1976 | Parker | 381/417 |
| 4,000,381 | A * | 12/1976 | Plice et al. | 381/418 |
| 4,363,980 | A * | 12/1982 | Petersen | 310/15 |
| 4,379,952 | A * | 4/1983 | Kaizer et al. | 381/404 |
| 4,540,975 | A * | 9/1985 | Kobayashi | 340/388.7 |
| 5,434,549 | A * | 7/1995 | Hirabayashi et al. | 335/229 |
| 5,809,157 | A * | 9/1998 | Grumazescu | 381/412 |
| 5,820,104 | A * | 10/1998 | Koyano et al. | 251/326 |
| 5,848,174 | A * | 12/1998 | Ki et al. | 381/404 |
| 5,947,155 | A * | 9/1999 | Miki et al. | 137/625.65 |
| 6,040,752 | A * | 3/2000 | Fisher | 335/234 |
| 6,157,100 | A * | 12/2000 | Mielke | 310/13 |
| 6,389,148 | B1 * | 5/2002 | Yoo et al. | 381/417 |
| 6,415,037 | B1 * | 7/2002 | Wang | 381/418 |
| 6,714,656 | B1 * | 3/2004 | Coffin | 381/420 |
| 6,870,454 | B1 * | 3/2005 | Vladimirescu et al. | 335/220 |
| 6,968,071 | B2 * | 11/2005 | Wang | 381/423 |
| 7,227,439 | B2 * | 6/2007 | Kelly | 335/229 |
| 7,787,645 | B2 * | 8/2010 | Clair et al. | 381/182 |

(Continued)

FOREIGN PATENT DOCUMENTS

| | | | |
|---|---|---|---|
| CH | 624522 | A5 * | 7/1981 |
| FR | 2674092 | A3 * | 9/1992 |
| GB | 2104343 | A * | 3/1983 |
| JP | 57018200 | A * | 1/1982 |

*Primary Examiner* — Edgardo San Martin
(74) *Attorney, Agent, or Firm* — Bacon & Thomas, PLLC

(57) ABSTRACT

The present invention is to provide a loudspeaker, which includes a frame having a through hole centrally provided at a bottom side thereof, a coil tube with a coil unit fixedly mounted around the outer periphery thereof and having a first end fixed to the through hole and a second end received in a receiving space of the frame, a diaphragm attached to periphery of an opening of the frame, and a plurality of oppositely oriented magnetic elements fixed on the diaphragm, wherein every two adjacent magnetic elements are spaced apart by an appropriate distance, and the magnetic elements are located in the coil tube at positions that magnetic lines generated by the coil unit are highly concentrated. Since vibration of the magnetic elements caused by the magnetic forces generated from the coil unit is enhanced, output power of the loudspeaker will increase accordingly.

10 Claims, 9 Drawing Sheets

U.S. PATENT DOCUMENTS

| | | | | |
|---|---|---|---|---|
| 7,856,115 | B2 * | 12/2010 | Clair et al. | 381/404 |
| 8,130,086 | B2 * | 3/2012 | Choi et al. | 340/407.1 |
| 2002/0071587 | A1 * | 6/2002 | Wang | 381/396 |
| 2005/0123166 | A1 * | 6/2005 | Chen et al. | 381/412 |
| 2011/0243369 | A1 * | 10/2011 | Wang | 381/400 |

* cited by examiner

LOUDSPEAKER WITH MAGNETIC ELEMENTS FIXEDLY PROVIDED ON DIAPHRAGM

FIELD OF THE INVENTION

The present invention relates to a loudspeaker, more particularly to a loudspeaker with a plurality of oppositely oriented magnetic elements fixed on a diaphragm of the loudspeaker, wherein every two adjacent magnetic elements are spaced apart by an appropriate distance, and the magnetic elements are located in a coil tube of the loudspeaker at positions that magnetic lines generated by a coil unit of the coil tube are highly concentrated. Since the attraction and repulsion of the magnetic elements caused by the magnetic forces generated from the coil unit is enhanced, the vibration of the magnetic elements transmitted to the diaphragm will in turn vibrate the surrounding air and hence increase the output power of the loudspeaker.

BACKGROUND OF THE INVENTION

The inventor of the present invention previously designed a loudspeaker structure as indicated at 10 in FIG. 1 of the present application. The loudspeaker structure 10 includes a frame 11, a coil tube 12, and a magnetic element 13. The frame 11 has a top side formed with a concave resonant chamber 111 and a bottom side centrally provided with a through hole 112. A diaphragm 113 is fixedly attached to a periphery of the frame 11 and extends toward the resonant chamber 111. The coil tube 12 is a hollow tube. A coil unit 121 is fixedly mounted around the outer periphery of the coil tube 12 and has a first end whose outer periphery is fixed to the periphery of the through hole 112 such that a second end of the coil tube 12 is received in the resonant chamber 111 of the frame 11. The magnetic element 13 has a first end fixedly provided at a central position of the diaphragm 113 and a second end extending toward and received in the second end of the coil tube 12. The second end of the magnetic element 13 can move reciprocally along the axis of the coil tube 12.

When a current passes through and thus magnetizes the coil unit 121, an electromagnetic effect is produced between a central position of the resonant chamber 111 and the through hole 112, and magnetic lines generated by the coil unit 121 and magnetic lines generated by the magnetic element 13 create attractive and repulsive forces. As the audio signal current input to the coil unit 121 varies in magnitude and direction, the magnetic element 13 vibrates reciprocally along the axis of the coil tube 12 and thereby vibrates the air around the diaphragm 113, causing the loudspeaker structure 10 to make sound.

After the coil unit 121 is magnetized by the current, the highest density of the magnetic lines generated takes place at the two ends of the coil unit 121. However, as the second end of the magnetic element 13 is received in the second end of the coil tube 12 and adjacent to one end of the coil unit 121, the magnetic element 13 is subjected only to the magnetic force generated by one end of the coil unit 121 and cannot take full advantage of the dense magnetic lines at the other end of the coil unit 121. Therefore, the responsiveness of the magnetic element 13 to the magnetic attraction and repulsion caused by the coil unit 121 is low, and so is the output power of the loudspeaker structure 10. As a result, the sound reproduced by the loudspeaker structure 10 has a low acoustic volume and cannot be clearly heard.

To solve the aforesaid problems, it has been proposed to enlarge the magnetic element 13 so that the length of the magnetic element 13 matches the winding width of the coil unit 121, thus allowing the magnetic element 13 to be adjacent to both ends of the coil unit 121 while received in the coil tube 12 and take full advantage of the magnetic forces generated from both ends of the coil unit 121. However, this proposition will increase the weight of the magnet element 13 to such extent that, when the coil unit 121 is magnetized and applies attractive and repulsive forces to the magnetic element 13, the magnetic element 13 is slow in responding to such magnetic forces and tends to cancel the forces partially. In consequence, the magnetic element 13 fails to transmit its vibration sufficiently to the diaphragm 113, and the intensity of vibration of the diaphragm 113 is lowered, thereby preventing the loudspeaker structure 10 from reproducing a powerful sound.

Therefore, the issue to be addressed by the present invention is to design a novel loudspeaker and thereby overcome the various problems associated with the invention disclosed in FIG. 1. The present invention aims at providing a loudspeaker with a diaphragm equipped with a plurality of magnetic elements which have opposite magnetic orientations, are appropriately spaced apart, and are located in a coil tube at positions corresponding to relatively dense magnetic lines, thus widening the range in which the magnetic elements are distributed to be exposed to the magnetic forces generated by a coil unit, enhancing the attraction and repulsion of the magnetic elements, increasing the intensity of vibration of the diaphragm, and consequently raising the output power of the loudspeaker.

BRIEF SUMMARY OF THE INVENTION

In view of the foregoing drawbacks of the prior art, the inventor of the present invention put years of practical experience into research and experiment and finally succeeded in developing a loudspeaker with magnetic elements fixedly provided on a diaphragm. The sound produced by this loudspeaker not only can be heard loud and clear, but also has a powerful tone quality.

It is an object of the present invention to provide a loudspeaker with magnetic elements fixedly provided on a diaphragm, wherein the loudspeaker includes a frame, a coil tube, a diaphragm, a first magnetic element, a connecting seat, a second magnetic element, and a first damping membrane. The frame is integrally formed of a metal plate by stamping or molding. An opening is formed at the top side of the frame, and a through hole is centrally provided at the bottom side of the frame. The frame also defines a receiving space therein. The coil tube is a hollow tube, with a coil unit fixedly mounted around the outer periphery of the coil tube. The coil tube has a first end whose outer periphery is fixed to the periphery of the through hole such that a second end of the coil tube is received in the receiving space of the frame. The diaphragm is attached to the periphery of the opening of the frame and extends toward the receiving space. The first magnetic element, which is a permanent magnet and is received in the coil tube, has a first end fixedly connected to a central position of the diaphragm and a second end extending toward the second end of the coil tube. The connecting seat has a first end fixedly attached to the second end of the first magnetic element and is received in the coil tube. The second magnetic element, which is also a permanent magnet, has a first end fixedly attached to a second end of the connecting seat such that the second magnetic element is received in the coil tube. The first damping membrane is a damping membrane with concentric corrugations and a central hole. The periphery of the central hole of the first damping membrane is mounted around and fixed to the first magnetic element at a position adjacent to the top side of the frame. The outer periphery of the first damping membrane is horizontally connected to a corresponding position of the frame. When a current flows through and thus magnetizes the coil unit on the outer periphery of the coil tube, magnetic lines generated by the coil unit and magnetic lines generated by the first and second magnetic elements cause attraction and repulsion and thereby drive the first magnetic element, the connecting seat, and the second magnetic element to vibrate reciprocally in the coil tube. In consequence, the diaphragm vibrates along with the first magnetic element, the connecting seat, and the second magnetic element and thereby vibrates the air in front of the loudspeaker to make sound. Meanwhile, the first damping membrane produces a balancing effect that allows the first magnetic element, the connecting seat, and the second magnetic element to vibrate reciprocally and stably in the coil tube. As is well known in the art, when the coil unit is magnetized by the current, the highest density of the magnetic lines generated occurs at the two ends of the coil unit. Therefore, by placing a plurality of oppositely oriented magnetic elements on the diaphragm of the loudspeaker, and spacing the magnetic elements apart by an appropriate distance such that the magnetic elements are located in the coil tube at positions adjacent to both ends of the coil unit, the range in which the magnetic elements are distributed to be exposed to the magnetic lines generated by the coil unit is widened, and attraction and repulsion of the magnetic elements caused by the magnetic forces generated from the coil unit is enhanced. Once the magnetic elements transmit their vibration to the diaphragm, the diaphragm vibrates the surrounding air sufficiently and hence increases the output power of the loudspeaker.

BRIEF DESCRIPTION OF THE SEVERAL VIEWS OF THE DRAWINGS

The invention as well as a preferred mode of use, further objects, and advantages thereof will be best understood by referring to the following detailed description of certain illustrative embodiments in conjunction with the accompanying drawings, in which.

DETAILED DESCRIPTION OF THE INVENTION

Figure 1:
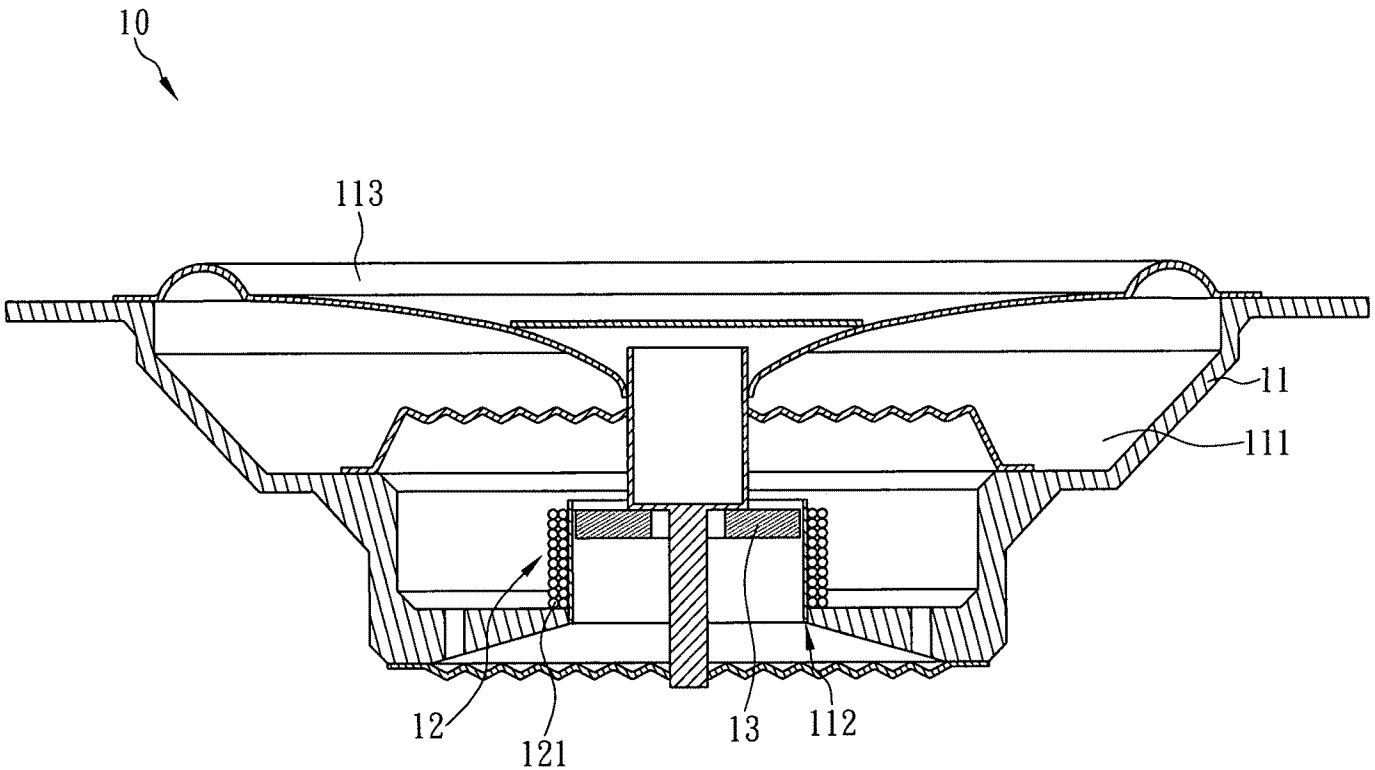
FIG. 1 (Prior Art)
FIG. 1 is a sectional view of a conventional loudspeaker structure.
Figure 2:
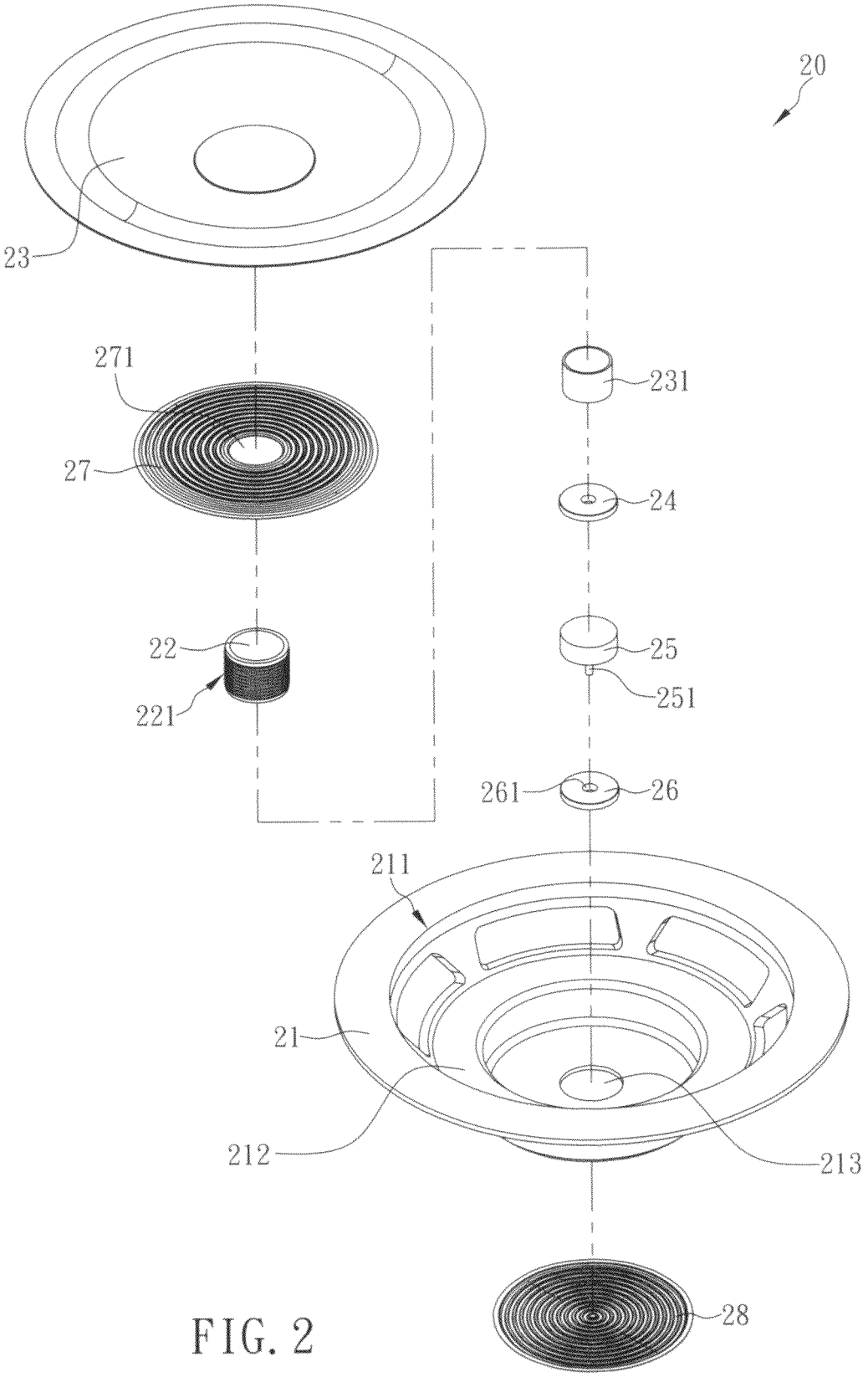
FIG. 2 is an exploded perspective view of a first preferred embodiment of the present invention.
Figure 3:
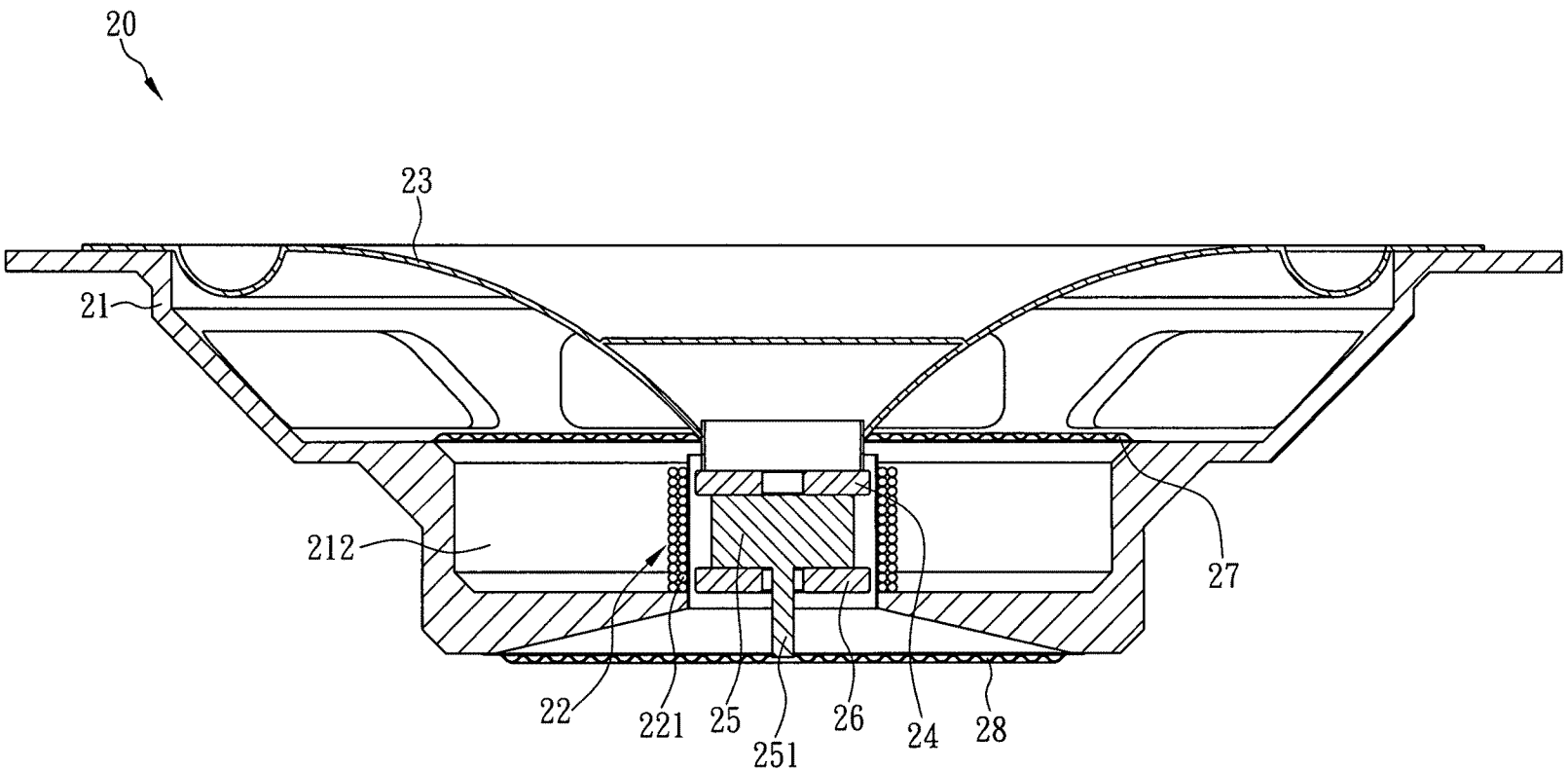
FIG. 3 is a sectional view of the first preferred embodiment of the present invention.

The present invention is directed to a loudspeaker with magnetic elements fixedly provided on a diaphragm. Referring to FIG. 2 and FIG. 3, a loudspeaker 20 according to a first preferred embodiment of the present invention includes a frame 21, a coil tube 22, a diaphragm 23, a first magnetic element 24, a connecting seat 25, a second magnetic element 26, a first damping membrane 27, and a second damping membrane 28. The frame 21 is integrally formed by stamping or molding a metal plate. The frame 21 has a top side formed with an opening 211 and a bottom side centrally provided with a through hole 213. Also, a receiving space 212 is defined in the frame 21.

The coil tube 22 is a hollow tube, and a coil unit 221 is fixedly mounted around the outer periphery of the coil tube 22. The coil tube 22 has a first end whose outer periphery is fixed to the periphery of the through hole 213 such that a second end of the coil tube 22 is received in the receiving space 212 of the frame 21. The diaphragm 23 is attached to the periphery of the opening 211 of the frame 21 and extends toward the receiving space 212. The first magnetic element 24 has a first end connected to a central position of the diaphragm 23 and is received in the coil tube 22 at a position corresponding to a first end of the coil unit 221. (In the present embodiment, the first magnetic element 24 is a permanent magnet, and the loudspeaker 20 further includes a hollow sleeve 231. The hollow sleeve 231 has a first end fixedly connected to the central position of the diaphragm 23 and a second end fixedly connected to the magnetic element 24 such that the magnetic element 24 is received in the coil tube 22 and corresponds in position to the first end of the coil unit 221). The connecting seat 25 has a first end connected to a second end of the first magnetic element 24 and is received in the coil tube 22. The connecting seat 25 further has a second end protrudingly provided with a central post 251. The second magnetic element 26, which has a magnetic orientation opposite to that of the first magnetic element 24, is centrally provided with an aperture 261 and has a first end connected to the second end of the connecting seat 25. Thus, the second magnetic element 26 is received in the coil tube 22 and corresponds in position to a second end of the coil unit 221 while the central post 251 passes through the aperture 261 and juts out of the first end of the coil tube 22. (In the present embodiment, the second magnetic element 26 is also a permanent magnet.)

As shown in FIG. 2 and FIG. 3, each of the first and second damping membranes 27, 28 is a damping membrane with concentric corrugations. The first damping membrane 27 has a central hole 271 whose periphery is connected and fixed to the diaphragm 23 at a position adjacent to the first magnetic element 24. The second damping membrane 28 has a central position connected and fixed to a bottom side of the central post 251. Furthermore, the outer periphery of each of the first and second damping membranes 27, 28 is horizontally connected to a corresponding position of the frame 21. (In a different embodiment of the present invention, the second damping membrane 28 is further provided with a second central hole whose periphery is mounted around and fixed to the central post 251 at a position adjacent to the bottom side of the frame 21.)

When a current flows through and thus magnetizes the coil unit 221 on the outer periphery of the coil tube 22, magnetic lines generated by the coil unit 221 and magnetic lines generated by the first and second magnetic elements 24, 26 cause attraction and repulsion and thereby drive the first magnetic element 24, the connecting seat 25, and the second magnetic element 26 to vibrate reciprocally in the coil tube 22. The diaphragm 23 vibrates in conjunction with the first magnetic element 24, the connecting seat 25, and the second magnetic element 26 and in turn vibrates the air in front of the loudspeaker 20 to make sound. At the same time, the first and second damping membranes 27, 28 produce a balancing effect that allows the first magnetic element 24, the connecting seat 25, and the second magnetic element 26 to vibrate not only reciprocally but also stably in the coil tube 22. As the coil unit 221, once magnetized by the current, generates the densest magnetic lines at its two ends, the plurality of magnetic elements (i.e., the first magnetic element 24 and the second magnetic element 26) which are provided on the diaphragm 23 of the loudspeaker 20, have opposite magnetic orientations, and are spaced apart by an appropriate distance so as to be located in the coil tube 22 at positions adjacent to the two ends of the coil unit 221, respectively, are arranged over a wide range in order to be exposed to the magnetic lines generated by the coil unit 221. Thus, attraction and repulsion of the magnetic elements by the magnetic forces generated from the coil unit 221 are enhanced, and when the vibration of the magnetic elements is transmitted to the diaphragm 23, the diaphragm 23 can vibrate the surrounding air sufficiently to substantially increase the output power of the loudspeaker 20.

Figure 4:
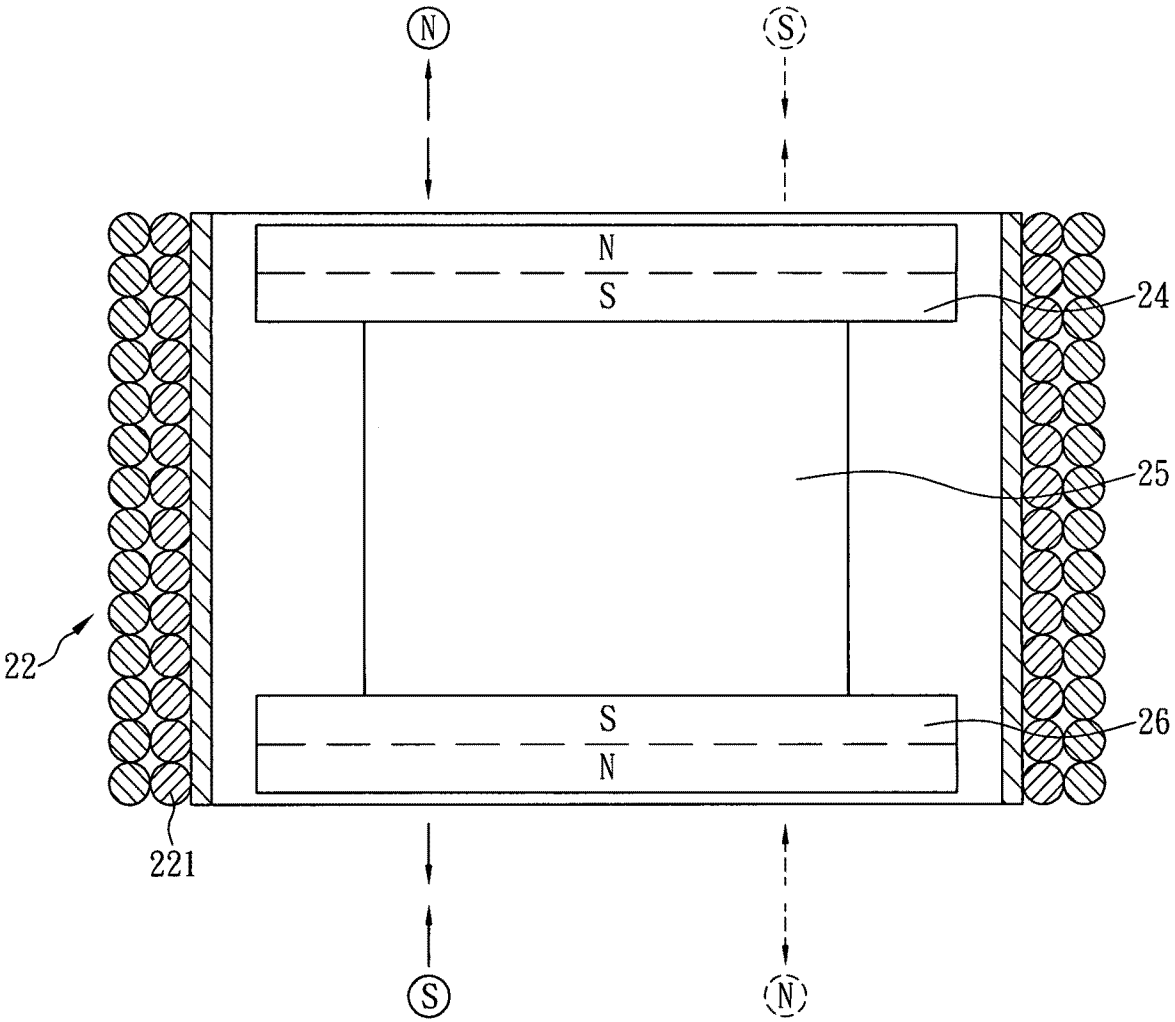
FIG. 4 is a partial sectional view of the first preferred embodiment of the present invention.

Referring to FIG. 4, the magnetic poles of the first and second magnetic elements 24, 26 in the coil tube 22 are arranged in opposite directions. (For instance, the first magnetic element 24 has its N pole disposed above the S pole, and the second magnetic element 26 has its S pole disposed above the N pole.) Therefore, when a current passes through and hence magnetizes the coil unit 221 on the outer periphery of the coil tube 22, resulting in instantaneous magnetic poles of the coil unit 221 (say, the N pole above the S pole), the N pole at the first end of the first magnetic element 24 is subjected to a downward repulsive force coming from the instantaneous N pole of the coil unit 221, and the N pole at the second end of the second magnetic element 26 is subjected to a downward attractive force coming from the instantaneous S pole of the coil unit 221. As a result, the first magnetic element 24 and the second magnetic element 26 are moved downward under the joint action of the two downward forces. On the contrary, when the instantaneous poles of the coil unit 221 are such that the S pole is above the N pole, the N pole at the first end of the first magnetic element 24 is subjected to an upward attractive force coming from the instantaneous S pole of the coil unit 221, and the N pole at the second end of the second magnetic element 26 is subjected to an upward repulsive force coming from the instantaneous N pole of the coil unit 221. In consequence, the first magnetic element 24 and the second magnetic element 26 are moved upward under the joint action of the two upward forces. Therefore, referring again to FIG. 3 and FIG. 4, by disposing the first and second magnetic elements 24, 26 in the coil tube 22 at positions adjacent to the two ends of the coil unit 221, respectively, the present invention allows the first and second magnetic elements 24, 26 of the loudspeaker 20 to take full advantage of the dense magnetic lines generated from both ends of the coil unit 221, thereby enhancing the attraction and repulsion of the first and second magnetic elements 24, 26 by the magnetic forces generated from the coil unit 221. Moreover, the overall weight of all the magnetic elements in the loudspeaker 20 is reduced to overcome the problems of the conventional loudspeakers that relate to the heavy weight of magnetic elements and the leakage of magnetic force. In addition, the costs of components and of transportation can be effectively lowered, and magnetic interference decreased, thereby enhancing the safety of the loudspeaker 20 when installed in specific places (e.g., in the onboard broadcasting system of an airplane).

Referring again to FIG. 2 and FIG. 3, while the loudspeaker 20 in the present embodiment includes the hollow sleeve 231, whose first end is fixedly connected to the central position of the diaphragm 23 and whose second end is fixedly connected to the first magnetic element 24 such that the first magnetic element 24 is received in the coil tube 22, the hollow sleeve 231 is not an essential feature of the loudspeaker 20. In a different embodiment of the present invention, the first magnetic element 24 has its first end connected to the central position of the diaphragm 23 and is received in the coil tube 22. Furthermore, in a different embodiment of the present invention, the second damping membrane 28 is provided on an outer bottom surface of the frame 21 or received in the receiving space 212 of the frame 21.

In the present embodiment, the central post 251 is not an essential feature of the connecting seat 25, and neither is the aperture 261 an essential feature of the second magnetic element 26. In a different embodiment of the present invention, the first end of the second magnetic element 26 is directly and fixedly attached to the second end of the connecting seat 25 such that the second magnetic element 26 is received in the coil unit 22; moreover, the second magnetic element 26 is fixedly connected to and appropriately spaced apart from the first magnetic element 24 by means of the connecting seat 25. The connecting seat 25 may have other configurations provided that it can be sandwiched between the first and second magnetic elements 24, 26 and keep an appropriate distance therebetween. In a different embodiment of the present invention, the first and second magnetic elements 24, 26 are not made of permanent magnets. The first and second magnetic element 24, 26 can be made of any material exhibiting magnetism or having magnetic permeability (e.g., metal or other magnetically permeable materials).

Figure 5:
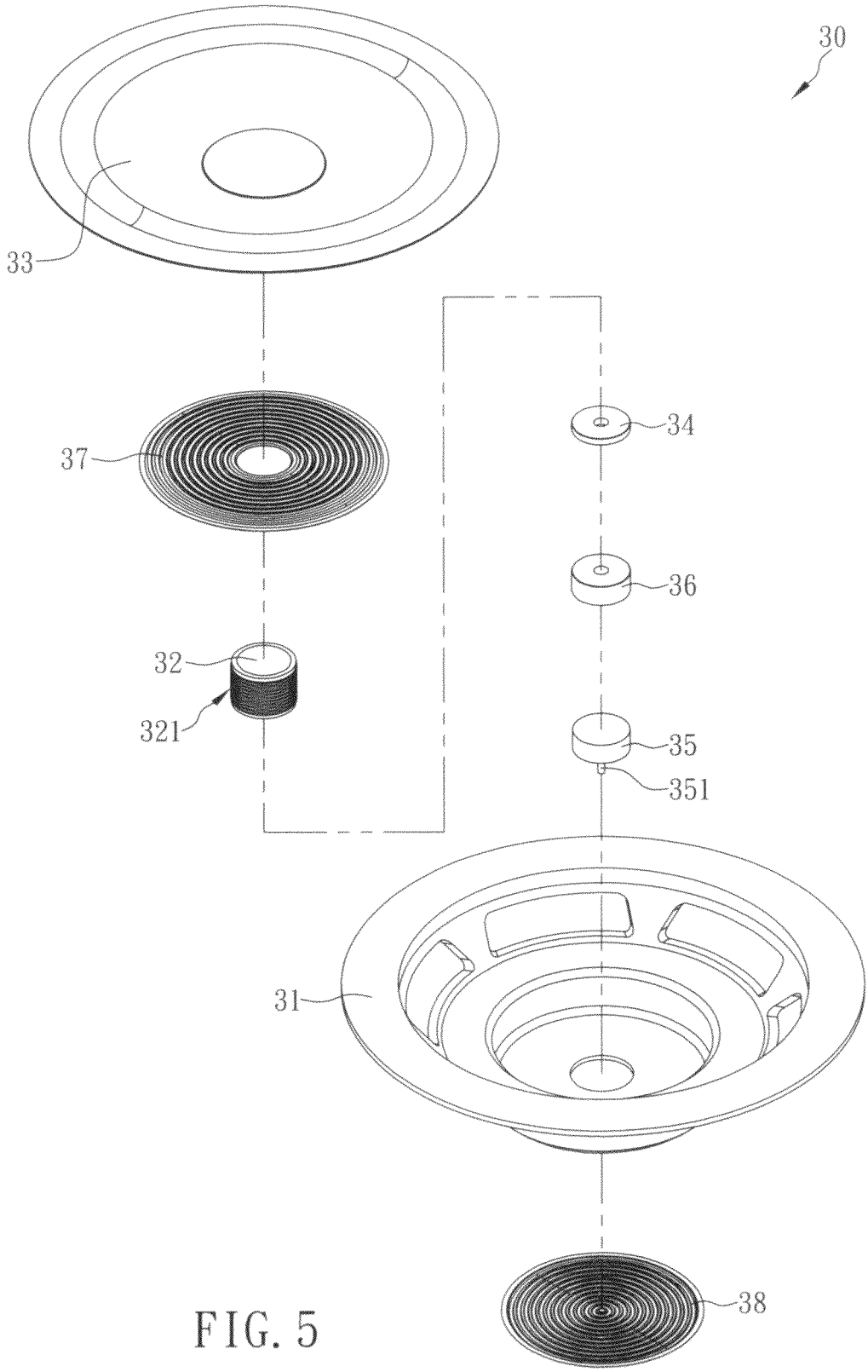
FIG. 5 is an exploded perspective view of a second preferred embodiment of the present invention.
Figure 6:
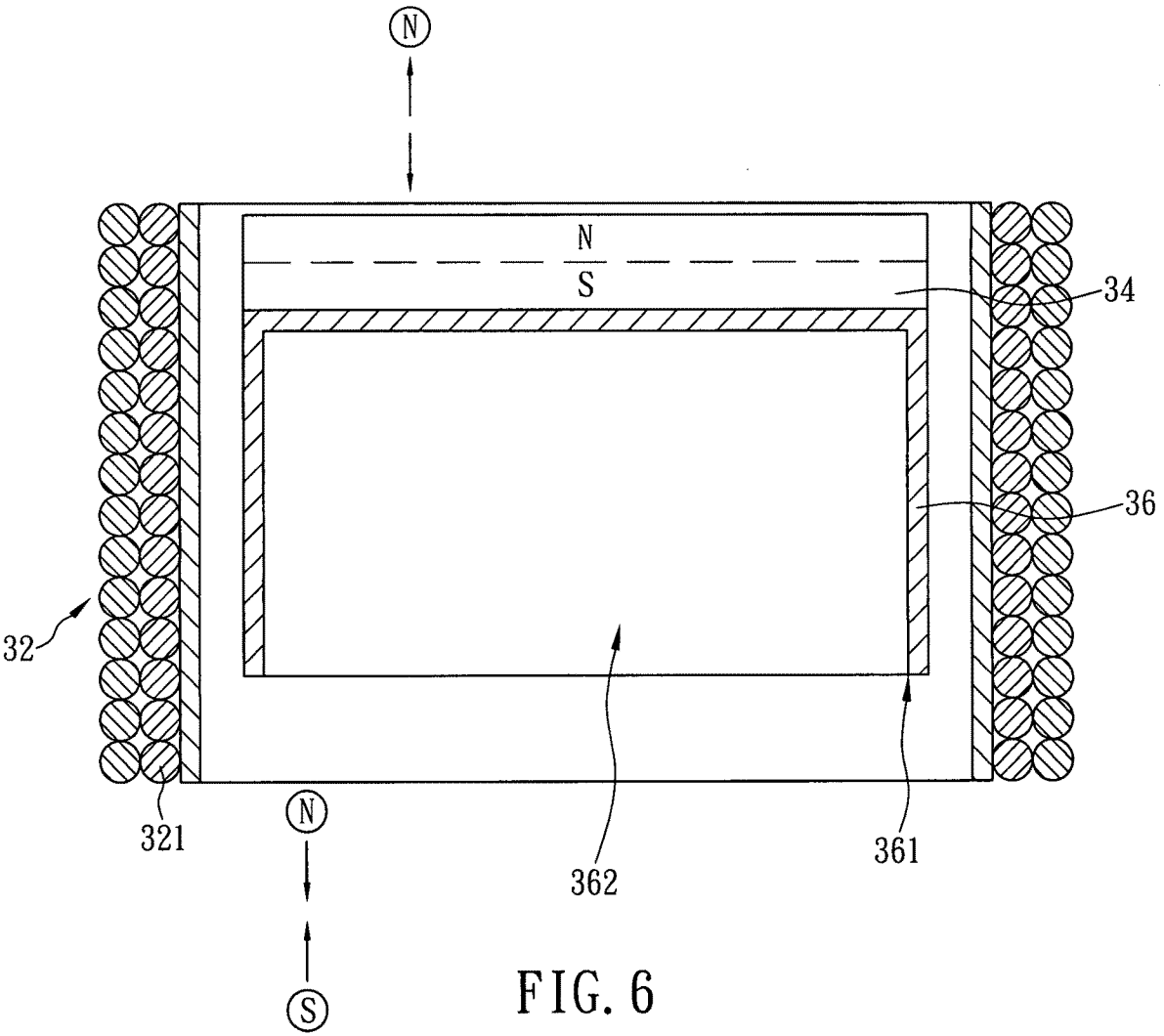
FIG. 6 is a partial sectional view of the second preferred embodiment of the present invention.

Referring to FIG. 5 and FIG. 6, a loudspeaker 30 according to a second preferred embodiment of the present invention includes a frame 31, a coil tube 32, a diaphragm 33, a first magnetic element 34, a second magnetic element 36, a connecting seat 35, a first damping membrane 37, and a second damping membrane 38. The first magnetic element 34, which is a permanent magnet, has a first end connected to a central position of the diaphragm 33 (i.e., the first magnetic element 34 being directly connected to the diaphragm 33 without using a hollow sleeve or other components) and is received in the coil tube 32 at a position corresponding to a first end of the coil unit 321. The second magnetic element 36 is a cylinder made of a magnetically permeable material and is received in the coil tube 32. The second magnetic element 36 has a first end fixedly attached to a second end of the first magnetic element 34 and a second end corresponding in position to a second end of the coil unit 321 and provided with a second opening 361. In addition, a second receiving space 362 is defined in the second magnetic element 36 and corresponds in position to the second opening 361. The connecting seat 35 has a first end positioned and received in the second receiving space 362 via the second opening 361. The connecting seat 35 further has a second end protrudingly provided with a central post 351. The central post 351 juts out of a first end of the coil tube 32 and has a bottom side fixedly connected to a central position of the second damping membrane 38. Hence, after the first end of the second magnetic element 36 is fixedly attached to the second end of the first magnetic element 34, the magnetic force generated by the first magnetic element 34 can be transmitted to the second magnetic element 36, thereby enabling the first and second magnetic elements 34, 36 to take full advantage of the dense magnetic lines generated from both ends of the coil unit 321. In consequence, the first and second magnetic elements 34, 36 can be attracted and repelled more effectively by the magnetic forces generated from the coil unit 321. Since the second magnetic element 36 is a metal cylinder with magnetic permeability rather than a solid metal block or permanent magnet, the overall weight of all the magnetic elements in the loudspeaker 30 is substantially reduced. Furthermore, the magnetic forces generated by all the magnetic elements match the magnetic forces generated by the coil unit 321 in terms of spatial range. Therefore, when a current flows through and thus magnetizes the coil unit 321 on the outer periphery of the coil tube 32, the first magnetic element 34 and the second magnetic element 36 can respond sensitively to the attractive and repulsive forces and transmit their vibration sufficiently to the diaphragm 33 without partially cancelling the attractive and repulsive forces.

Referring to FIG. 6, as the first end of the second magnetic element 36 in the coil tube 32 is fixedly attached to the second end of the first magnetic element 34, the magnetic force generated by the first magnetic element 34 can be transmitted to the second magnetic element 36. For instance, when the first magnetic element 34 is so disposed that the N pole is above the S pole, the first end of the second magnetic element 36 is magnetized by the S pole of the first magnetic element 34 and becomes an N pole. On the other hand, the second end of the second magnetic element 36 is located away from the first magnetic element 34, generates a relatively weak magnetic force, and is therefore magnetized by the instantaneous magnetic poles of the coil unit 321. Thus, the first and second magnetic elements 34, 36 can take full advantage of the dense magnetic lines generated from both ends of the coil unit 321. More particularly, when a current passes through and hence magnetizes the coil unit 321 on the outer periphery of the coil tube 32, resulting in instantaneous magnetic poles of the coil unit 321 (say, the N pole above the S pole, such that the second end of the second magnetic element 36 is magnetized by the instantaneous S pole at the lower end of the coil unit 321 and becomes an N pole), the N pole at the first end of the first magnetic element 34 is subjected to a downward repulsive force coming from the instantaneous N pole of the coil unit 321, and the N pole at the second end of the second magnetic element 36 is subjected to a downward attractive force coming from the instantaneous S pole of the coil unit 321. Consequently, the first magnetic element 34 and the second magnetic element 36 are moved downward under the joint action of the two downward forces. In short, referring to FIG. 5 and FIG. 6, by fixedly attaching the first end of the second magnetic element 36 to the second end of the first magnetic element 34 (thus allowing the magnetic force generated by the first magnetic element 34 to be transmitted to the second magnetic element 36) and by locating the first and second magnetic elements 34, 36 in the coil tube 32 at positions adjacent to the two ends of the coil unit 321, respectively, the present invention allows the first and second magnetic elements 34, 36 of the loudspeaker 30 to take full advantage of the dense magnetic lines generated from both ends of the coil unit 321 and be effectively attracted and repelled by the magnetic forces generated from the coil unit 321. Also, the overall weight of all the magnetic elements in the loudspeaker 30 is reduced, and the output power of the loudspeaker 30 significantly increased.

Figure 7:
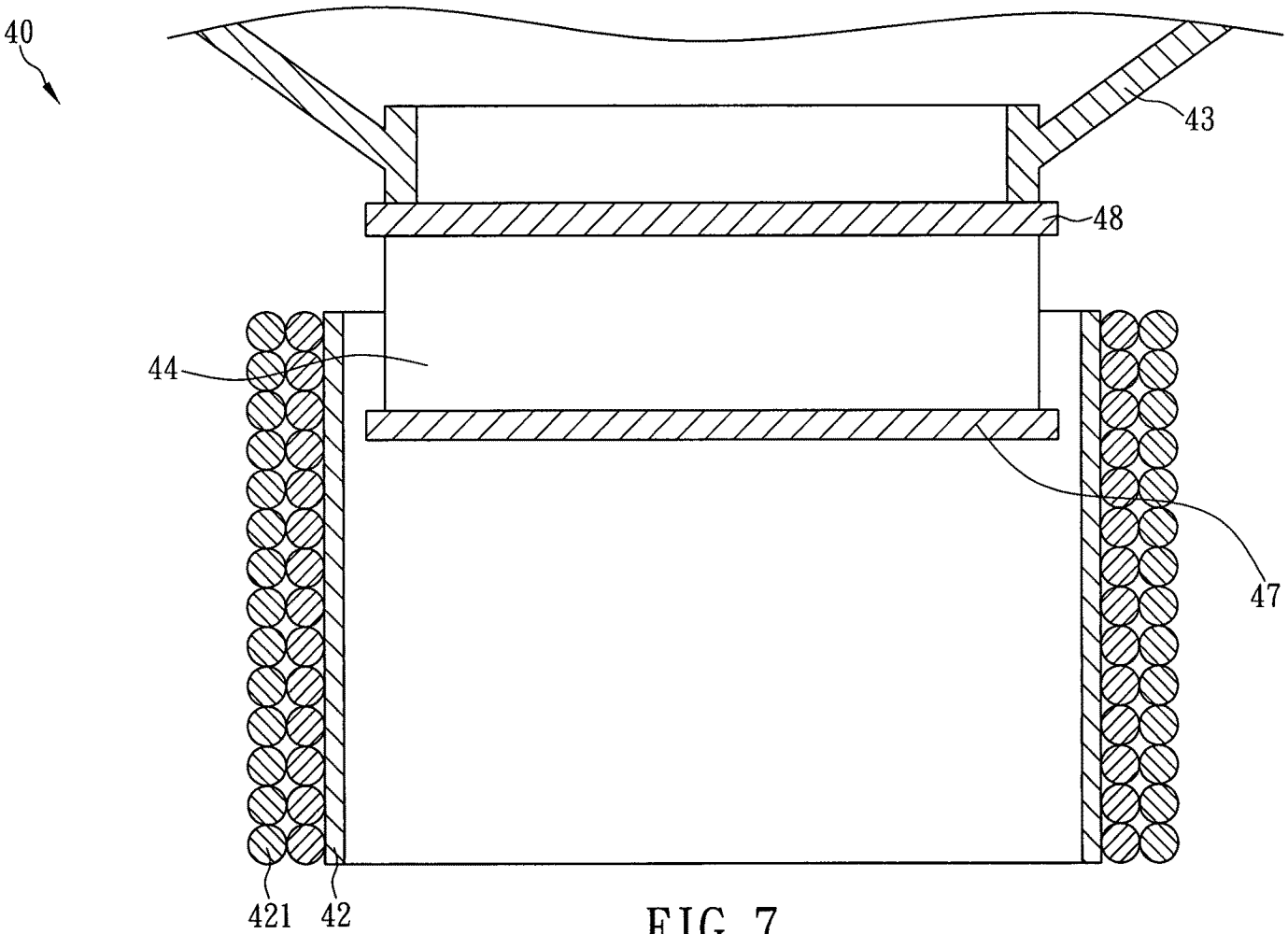
FIG. 7 is a partial sectional view of a third preferred embodiment of the present invention.

Please refer to FIG. 7 for a third preferred embodiment of the present invention, wherein a loudspeaker 40 includes a third magnetic element 48 and a magnetically permeable plate 47 in addition to a coil tube 42, a coil unit 421, a diaphragm 43, and a first magnetic element 44. The third magnetic element 48, which is made of a magnetically permeable material, has a first end fixedly connected to a central position of the diaphragm 43 and a second end fixedly connected to a first end of the first magnetic element 44. The second end of the third magnetic element 48 is provided adjacent to a first end of the coil tube 42 such that the first magnetic element 44 is received in the coil tube 42 and corresponds in position to a first end of the coil unit 421. The magnetically permeable plate 47 is made of metal and has a top side fixedly attached to a second end of the first magnetic element 44.

Figure 8:
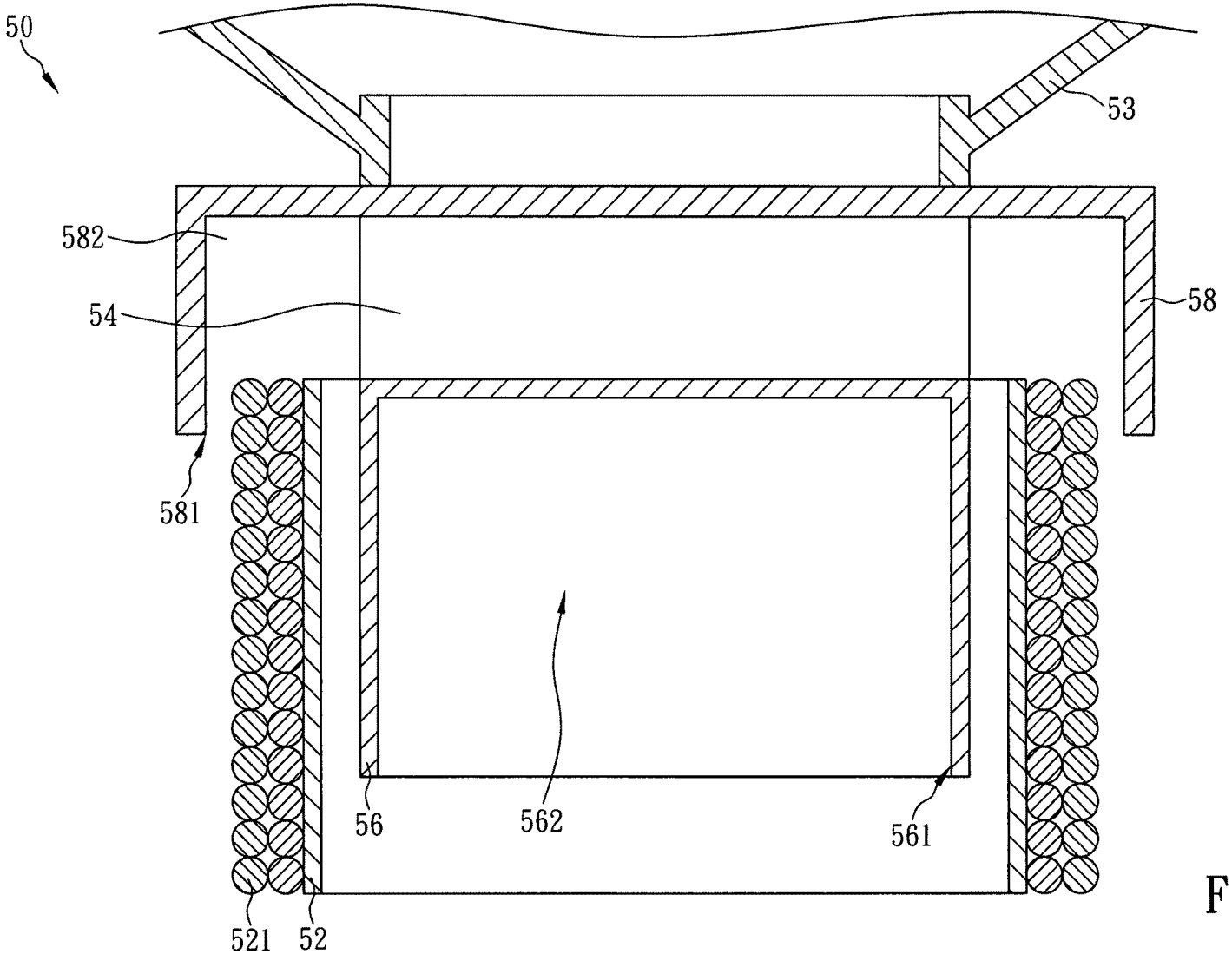
FIG. 8 is a partial sectional view of a fourth preferred embodiment of the present invention.

Referring to FIG. 8, a loudspeaker 50 according to a fourth preferred embodiment of the present invention includes a third magnetic element 58 in addition to a coil tube 52, a coil unit 521, a diaphragm 53, a first magnetic element 54, and a second magnetic element 56. The third magnetic element 58 is a cylinder made of a magnetically permeable material, wherein the inner diameter of the cylinder (i.e., the third magnetic element 58) is larger than the outer diameter of the coil tube 52. The third magnetic element 58 has a first end fixedly connected to a central position of the diaphragm 53 and a second end provided with a third opening 581. A third receiving space 582 is defined in the third magnetic element 58 and corresponds in position to the third opening 581, thus allowing a first end of the first magnetic element 54 to be positioned and received in the third receiving space 582 via the third opening 581. The second end of the third magnetic element 58 is adjacent to and covers a first end of the coil tube 52 such that the first magnetic element 54 is received in the coil tube 52 and corresponds in position to a first end of the coil unit 521. The second magnetic element 56 is a cylinder made of a magnetically permeable material and is received in the coil tube 52. The second magnetic element 56 has a first end fixedly attached to a second end of the first magnetic element 54 and a second end corresponding in position to a second end of the coil unit 52 and having a second opening 561. A second receiving space 562 is defined in the second magnetic element 56 and corresponds in position to the second opening 561.

Figure 9:
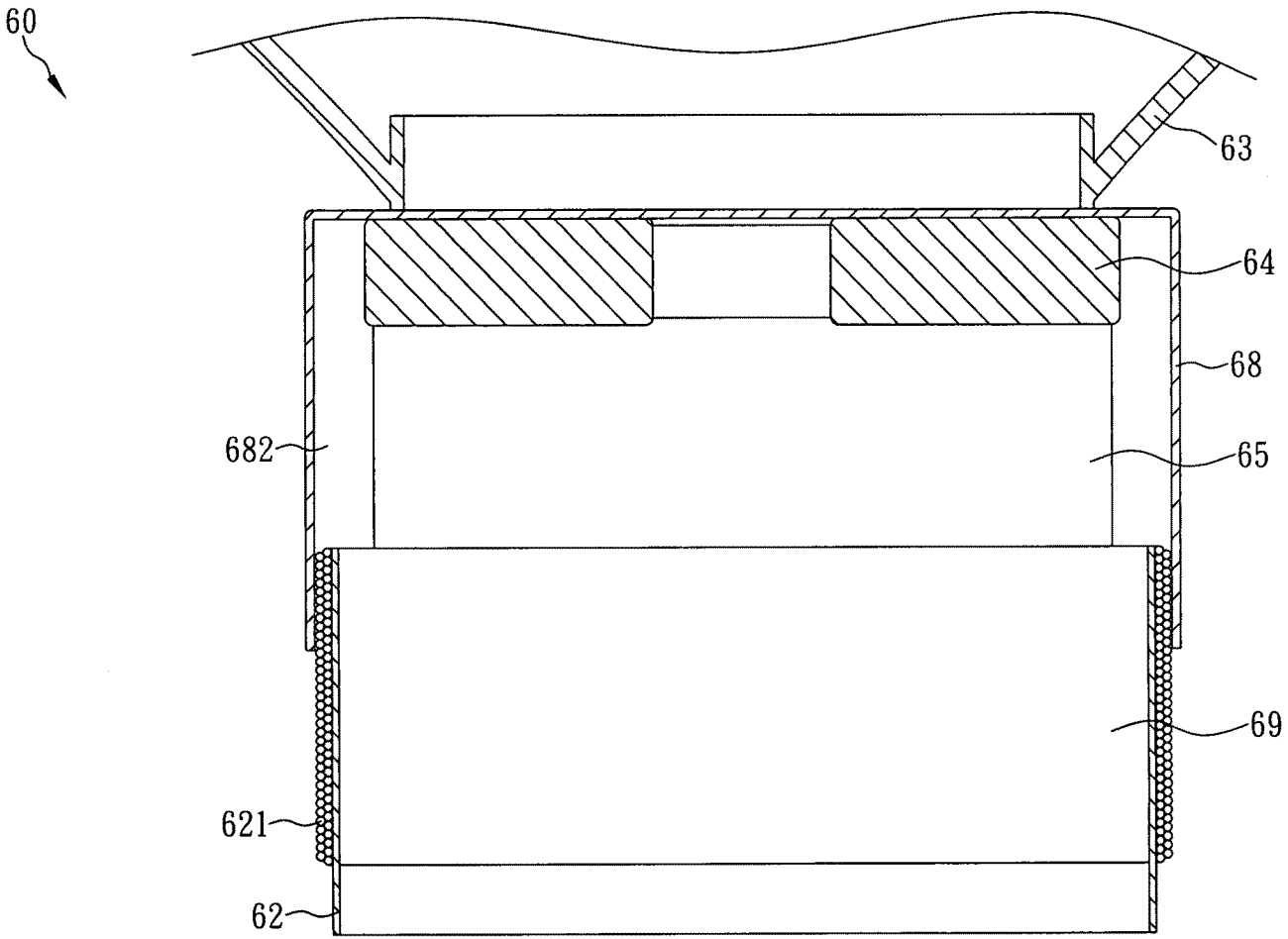
FIG. 9 is a partial sectional view of a fifth preferred embodiment of the present invention.

FIG. 9 illustrates a loudspeaker 60 according to a fifth preferred embodiment of the present invention. The loudspeaker 60 includes a cylindrical element 68 in addition to a coil tube 62, a coil unit 621, a diaphragm 63, a first magnetic element 64, and a connecting seat 65. The cylindrical element 68 is a cylinder made of a non-magnetically permeable material (e.g., aluminum). The inner diameter of the cylinder (i.e., the cylindrical element 68) is larger than the outer diameter of the coil tube 62 (wherein the coil unit 621 is fixedly mounted around the outer periphery of the coil tube 62) so as to keep the first magnetic element 64 coaxially centered in relation to the coil tube 62. The cylindrical element 68 has a first end fixedly connected to a central position of the diaphragm 63 and a second end concavely provided with a third receiving space 682 in which a first end of the first magnetic element 64 is positioned and received. The connecting seat 65 has a first end connected to a second end of the first magnetic element 64 and is received in the third receiving space 682. The connecting seat 65 further has a second end fixedly connected to a first end of an iron core 69 such that the iron core 69 is received in the coil tube 62. In the present embodiment, the connecting seat 65 is a resilient cotton pad and functions as a cushion between the first magnetic element 64 and the iron core 69 to prevent the first magnetic element 64 and the iron core 69 from damage which may otherwise result from collision therebetween.

While the invention herein disclosed has been described by means of specific embodiments, numerous modifications and variations could be made thereto by those skilled in the art without departing from the scope and spirit of the invention set forth in the claims.

What is claimed is:

1. A loudspeaker with magnetic elements fixedly provided on a diaphragm, the loudspeaker comprising:

a frame integrally formed by stamping or molding a metal plate, wherein the frame has a top side formed with an opening and a bottom side centrally provided with a through hole, and the frame defines therein a receiving space;

a coil tube formed as a hollow tube, wherein a coil unit is fixedly mounted around an outer periphery of the coil tube, and the coil tube has a first end whose outer periphery is fixed to a periphery of the through hole such that a second end of the coil tube is received in the receiving space of the frame;

a diaphragm attached to a periphery of the opening of the frame and extending toward the receiving space;

a first magnetic element having a first end connected to a central position of the diaphragm, wherein the first magnetic element is received in the coil tube and corresponds in position to a first end of the coil unit;

a connecting seat received in the coil tube and having a first end connected to a second end of the first magnetic element;

a second magnetic element having a first end connected to a second end of the connecting seat, wherein the second magnetic element is received in the coil tube, corresponds in position to a second end of the coil unit, and has a magnetic orientation opposite to that of the first magnetic element;

a third magnetic element made of a magnetically permeable material, formed as a cylinder, and having an inner diameter larger than an outer diameter of the coil tube, wherein the third magnetic element has a first end fixedly connected to the central position of the diaphragm, a second end formed with a second opening, and a second receiving space therein and corresponding in position to the second opening, such that the first end of the first magnetic element is positioned and received in the second receiving space via the second opening, and the second end of the third magnetic element is adjacent to and covers the first end of the coil tube; and a first damping membrane having concentric corrugations and a central hole, wherein the central hole of the first damping membrane has a periphery fixedly connected to the diaphragm at a position adjacent to the first magnetic element, and an outer periphery of the first damping membrane is horizontally connected to a corresponding position of the frame.

2. The loudspeaker of claim 1, further comprising a plate made of metal, wherein the plate has a top side fixedly attached to the second end of the first magnetic element and a bottom side fixedly connected to the first end of the connecting seat.

3. The loudspeaker of claim 2, wherein the second magnetic element is a cylinder made of a magnetically permeable material and has a second end formed with a third opening, and the second magnetic element defines therein a third receiving space corresponding in position to the third opening.

4. The loudspeaker of claim 3, wherein the second end of the connecting seat is protrudingly provided with a central post, and the second magnetic element is centrally provided with an aperture, the central post passing through the aperture and jutting out of the first end of the coil tube.

5. The loudspeaker of claim 4, further comprising a second damping membrane, wherein the second damping membrane has a central position fixedly attached to a bottom side of the central post and an outer periphery horizontally connected to a corresponding position of the frame.

6. The loudspeaker of claim 4, further comprising a second damping membrane, wherein the second damping membrane has a second central hole whose periphery is mounted around and fixed to the central post at a position adjacent to the bottom side of the frame, and the second damping membrane has an outer periphery horizontally connected to a corresponding position of the frame.

7. A loudspeaker with magnetic elements fixedly provided on a diaphragm, the loudspeaker comprising:

a frame integrally formed by stamping or molding a metal plate, wherein the frame has a top side formed with an opening and a bottom side centrally provided with a through hole, and the frame defines therein a receiving space;

a coil tube formed as a hollow tube, wherein a coil unit is fixedly mounted around an outer periphery of the coil tube, and the coil tube has a first end whose outer periphery is fixed to a periphery of the through hole such that a second end of the coil tube is received in the receiving space of the frame;

a diaphragm attached to a periphery of the opening of the frame and extending toward the receiving space;

a first magnetic element having a first end connected to a central position of the diaphragm, wherein the first magnetic element is received in the coil tube and corresponds in position to a first end of the coil unit;

a second magnetic element made of a magnetically permeable material, formed as a cylinder, and received in the coil tube, wherein the second magnetic element has a first end fixedly attached to a second end of the first magnetic element and a second end corresponding in position to a second end of the coil unit and formed with a second opening, and the second magnetic element defines therein a second receiving space corresponding in position to the second opening;

a third magnetic element made of a magnetically permeable material, formed as a cylinder, and having an inner diameter larger than an outer diameter of the coil tube, wherein the third magnetic element has a first end fixedly connected to the central position of the diaphragm, a second end formed with a third opening, and a third receiving space therein and corresponding in position to the third opening, such that the first end of the first magnetic element is positioned and received in the third receiving space via the third opening, and the second end of the third magnetic element is adjacent to and covers the first end of the coil tube; and a first damping membrane having concentric corrugations and a central hole, wherein the central hole of the first damping membrane has a periphery fixedly connected to the diaphragm at a position adjacent to the first magnetic element, and an outer periphery of the first damping membrane is horizontally connected to a corresponding position of the frame.

8. The loudspeaker of claim 7, further comprising a connecting seat having a first end positioned and received in the second receiving space via the second opening and a second end protrudingly provided with a central post.

9. The loudspeaker of claim 8, further comprising a second damping membrane, wherein the second damping membrane has a central position fixedly attached to a bottom side of the central post and an outer periphery horizontally connected to a corresponding position of the frame.

10. The loudspeaker of claim 8, further comprising a second damping membrane, wherein the second damping membrane has a second central hole whose periphery is mounted around and fixed to the central post at a position adjacent to the bottom side of the frame.

* * * * *